US007669524B2

(12) United States Patent
Koreda et al.

(10) Patent No.: US 7,669,524 B2
(45) Date of Patent: Mar. 2, 2010

(54) HULLED RICE DISTRIBUTION DEVICE IN RICE HULLER

(75) Inventors: Minoru Koreda, Tokyo (JP); Hiroyuki Kagota, Tokyo (JP)

(73) Assignee: Satake Corporation, Tokyo (JP)

( * ) Notice: Subject to any disclaimer, the term of this patent is extended or adjusted under 35 U.S.C. 154(b) by 260 days.

(21) Appl. No.: 10/591,902

(22) PCT Filed: Oct. 11, 2005

(86) PCT No.: PCT/JP2005/018683

§ 371 (c)(1),
(2), (4) Date: Sep. 7, 2006

(87) PCT Pub. No.: WO2006/041053

PCT Pub. Date: Apr. 20, 2006

(65) Prior Publication Data

US 2007/0193455 A1 Aug. 23, 2007

(30) Foreign Application Priority Data

Oct. 14, 2004 (JP) ..... 2004-300766

(51) Int. Cl.
*B02B 3/00* (2006.01)

(52) U.S. Cl. ..... 99/488; 99/519; 99/523; 99/524; 99/609; 99/618; 99/620; 99/621

(58) Field of Classification Search ..... 99/486, 99/488, 489, 600, 518, 519, 523–525, 609–611, 99/612–615, 617–625; 241/7, 11, 14, 37, 241/42, 49, 74; 426/481–483, 518
See application file for complete search history.

(56) References Cited

U.S. PATENT DOCUMENTS

| | | | | | |
|---|---|---|---|---|---|
| 3,885,464 | A * | 5/1975 | Ceballos-Aguilera | 99/605 |
| 3,960,068 | A * | 6/1976 | Salete | 99/606 |
| 3,995,542 | A * | 12/1976 | Miecke | 99/569 |
| 4,194,445 | A * | 3/1980 | Gemsjager | 99/618 |
| 4,196,224 | A * | 4/1980 | Falk | 426/483 |
| 4,292,890 | A * | 10/1981 | Salete-Garces | 99/603 |
| 4,693,903 | A * | 9/1987 | Halwani | 426/456 |
| 6,347,579 | B1 * | 2/2002 | Houri et al. | 99/488 |
| 7,296,511 | B2 * | 11/2007 | Koreda et al. | 99/488 |
| 2001/0013559 | A1 | 8/2001 | Yamamoto et al. | |

FOREIGN PATENT DOCUMENTS

| | | |
|---|---|---|
| JP | 56-70845 | 6/1981 |
| JP | 2001-219082 | 8/2001 |
| JP | 2001347172 A * | 12/2001 |

* cited by examiner

*Primary Examiner*—Timothy F. Simone
(74) *Attorney, Agent, or Firm*—Staas & Halsey LLP

(57) ABSTRACT

A hulled rice distribution device (30) is disposed between a hulling section (10) and a wind sorting section (60) of a rice huller (1). This distribution device (30) comprises an distribution gutter (35) for receiving hulled rice falling from the hulling section, and a screw (32) for conveying the hulled rice having flowed into the distribution gutter (35) in the lengthwise direction of the distribution gutter. A plurality of holes (41, 42 and 43) for the hulled rice to fall through are formed in the distribution gutter (35), and some of them may be blocked or opened by a falling rice control plate (34).

3 Claims, 6 Drawing Sheets

HULLED RICE DISTRIBUTION DEVICE IN RICE HULLER

CROSS REFERENCE TO RELATED APPLICATIONS

This application claims benefit to PCT International Application Number PCT/JP2005/018683, filed on Oct. 11, 2005 and Japanese Application No. 2004-300766, filed Oct. 14, 2004 in Japan, the disclosures of which are incorporated herein by reference.

TECHNICAL FIELD

The present invention relates to a hulled rice distribution device for use in a rice huller, which selects chaff out of hulled rice by blowing sorting air on the hulled rice in a wind sorting section, the hulled rice being produced by processing unhulled rice as raw material by means of a hulling section of the rice huller.

BACKGROUND ART

Conventionally, a hulled rice distribution device of this kind consists of an distribution gutter having a plurality of holes for dropping hulled rice through, and a screw for evenly conveying in the lengthwise direction of the distribution gutter the hulled rice having flowed from the hulling section into the distribution gutter, and the flow rate of the hulled rice flowing through this plurality of holes is controlled by regulating the plurality of holes from outside that distribution gutter.

Further, a technique to facilitate uniform distribution of hulled rice by providing scraping means for scraping the hulled rice on the screw disposed in the distribution gutter and fitting on one side of that distribution gutter an overflow control member for adjusting the quantity of hulled rice overflowing the upper end edge of that distribution gutter is disclosed in Japanese Patent Application Laid-Open No. 2001-219082.

However, by the technique described above, where a raw material with contents differing in property, such as long grains and short grains, is to be processed, there is a problem that the quantity of hulled rice dropping through the plurality of holes of the distribution gutter varies so widely that it can not be regulated by a mechanism for regulating an uniform distribution process. Moreover, when the flow rate is to be altered, the feeding of the raw material has to be once suspended and controlling member has to be readjusted after the device is stopped, thereby entailing much trouble.

DISCLOSURE OF THE INVENTION

In view of the problem noted above, an object of the present invention is to provide a rice huller provided with an distribution device which enables the variety and flow rate of the raw material to be altered individually by simple manipulation even when the device is in operation, and allows uniform dispersion even when the raw material contents are different in properties.

In order to achieve the object stated above, in an distribution device for hulled rice in a rice huller according to the invention, the rice huller comprises a hulling section which hulls raw material (un-hulled rice), wind sorting section arranged underneath the hulling section, and a hulled rice distribution device disposed between the hulling section and wind sorting section. The distribution device comprises: the distribution device comprises an distribution gutter which receives hulled rice falling from the hulling section and in which a plurality of hulled rice falling-through holes are formed; a downflow gutter which is linked to one of the upper end edges of the distribution gutter and guides hulled rice from the hulling section to the substantially central part of the distribution gutter in the lengthwise direction; a screw which is disposed inside the distribution gutter and conveys hulled rice having flowed into the distribution gutter in the lengthwise direction of the distribution gutter; and a falling rice control plate which can block and open at least some of the hulled rice falling-through holes formed in the distribution gutter. A part of the hulled rice which failed to fall through the hulled rice falling-through holes, out of the hulled rice which has flowed into the distribution gutter, in the process of being conveyed by the screw, is caused to overflow the upper end edge of the distribution gutter on the side opposite the upper end edge linked to the downflow gutter.

With the above configuration, in case of a long grain variety which is greater in grain length and difficult to fall through a plurality of holes formed in the distribution gutter, rice grain can fall through more holes by moving the falling rice control plate away from the distribution gutter. Incase of a medium or short grain variety which can easily fall through the plurality of holes in the distribution gutter, on the other hand, adjustment can be made by bringing the falling rice control plate into contact with the distribution gutter to reduce the number of holes through which the rice can fall.

The hulled rice distribution device according to the invention can take on the following modes.

The upper end edge of the distribution gutter which hulled rice is to overflow is so inclined as to increase in height in the part substantially immediately underneath the hulling section and to become gradually lower with the increase in distance from that part in the lengthwise direction of the distribution gutter.

A recessed part is formed in the part substantially immediately underneath the hulling section at the upper end edge of the distribution gutter which hulled rice is to overflow, and an overflowing rice control plate is disposed in a position corresponding to this recessed part so as to be shiftable between a state in which the recessed part is blocked and a state in which it is opened, thereby controlling with this overflowing rice control plate the quantity of hulled rice over flowing the distribution gutter through the recessed part.

The falling rice control plate and overflowing rice control plate are fitted to a first shaft and a second shaft concentric therewith, those first and second shafts are rotatably supported by a machine frame of the rice huller independent of each other and, moreover, the rotation of those first and second shafts is enabled to be manipulated from outside the machine frame.

BEST MODE FOR CARRYING OUT THE INVENTION

Figure 1:
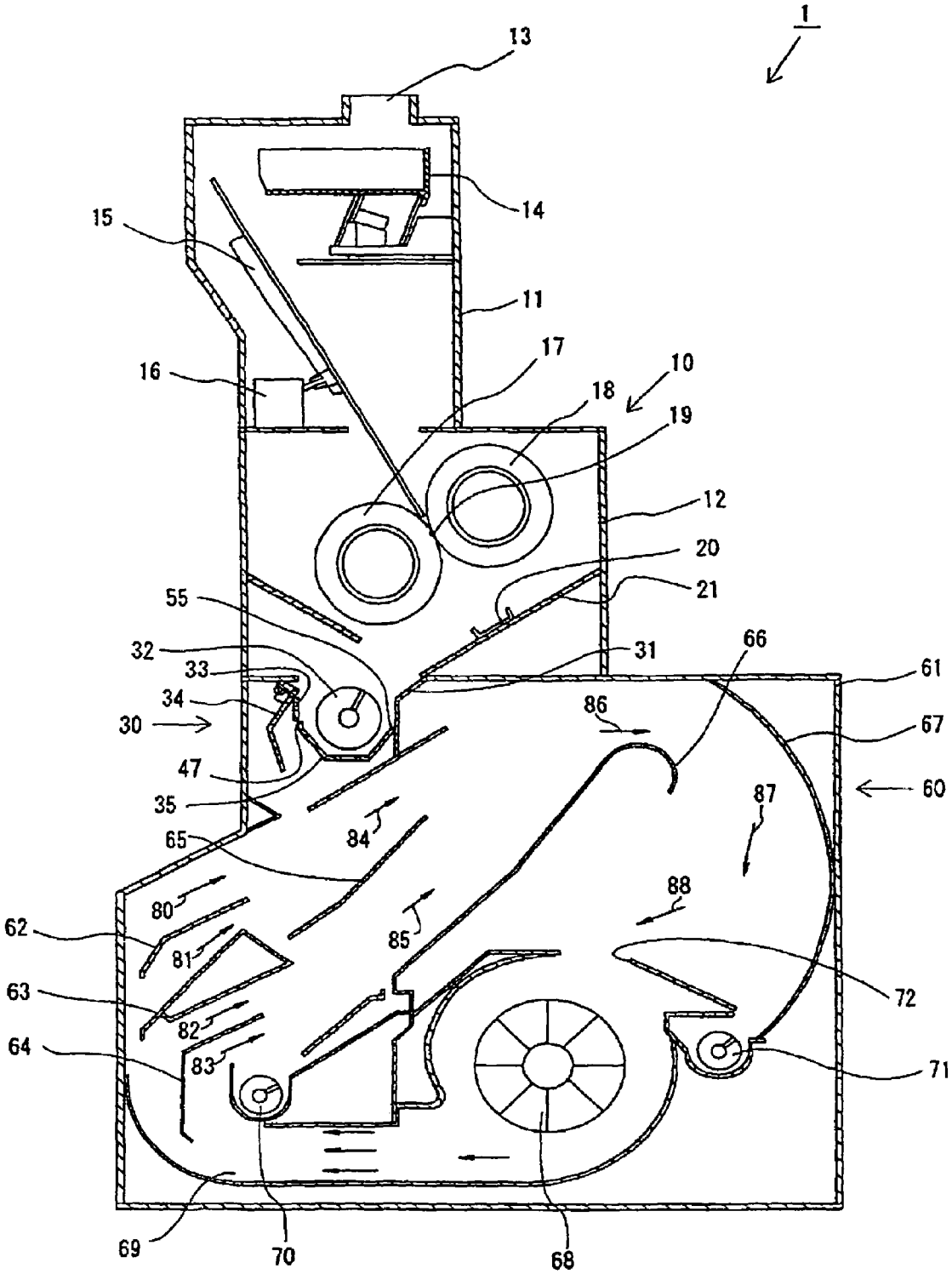
FIG. 1 is a longitudinal section showing the overall structure of a rice huller with a hulled rice distribution device according to the present invention built into it.

The overall structure of a rice huller with a hulled rice distribution device according to the present invention built into it will be described with reference to FIG. 1.

A rice huller 1 comprises a hulling section 10, a wind sorting section 60 disposed underneath the hulling section 10, and a hulled rice distribution device 30 disposed between those hulling section 10 and wind sorting section 60. The hulling section 10 is disposed on the upper machine frame 11 and the intermediate machine frame 12 of the rice huller 1. The wind sorting section 60 and the distribution device 30 are disposed on the lower machine frame 61 of the rice huller 1.

A pair of rubber rolls 17 and 18 constituting the hulling section 10 are so supported by the intermediate machine frame 12 that their rotation shafts can rotate and one of the rotation shafts can move toward and away from the other of the rotation shafts. These paired rubber rolls 17 and 18 are rotationally driven by a motor and a belt (not shown) in reverse directions to, and with a difference in circumferential speed from each other.

Figure 4:
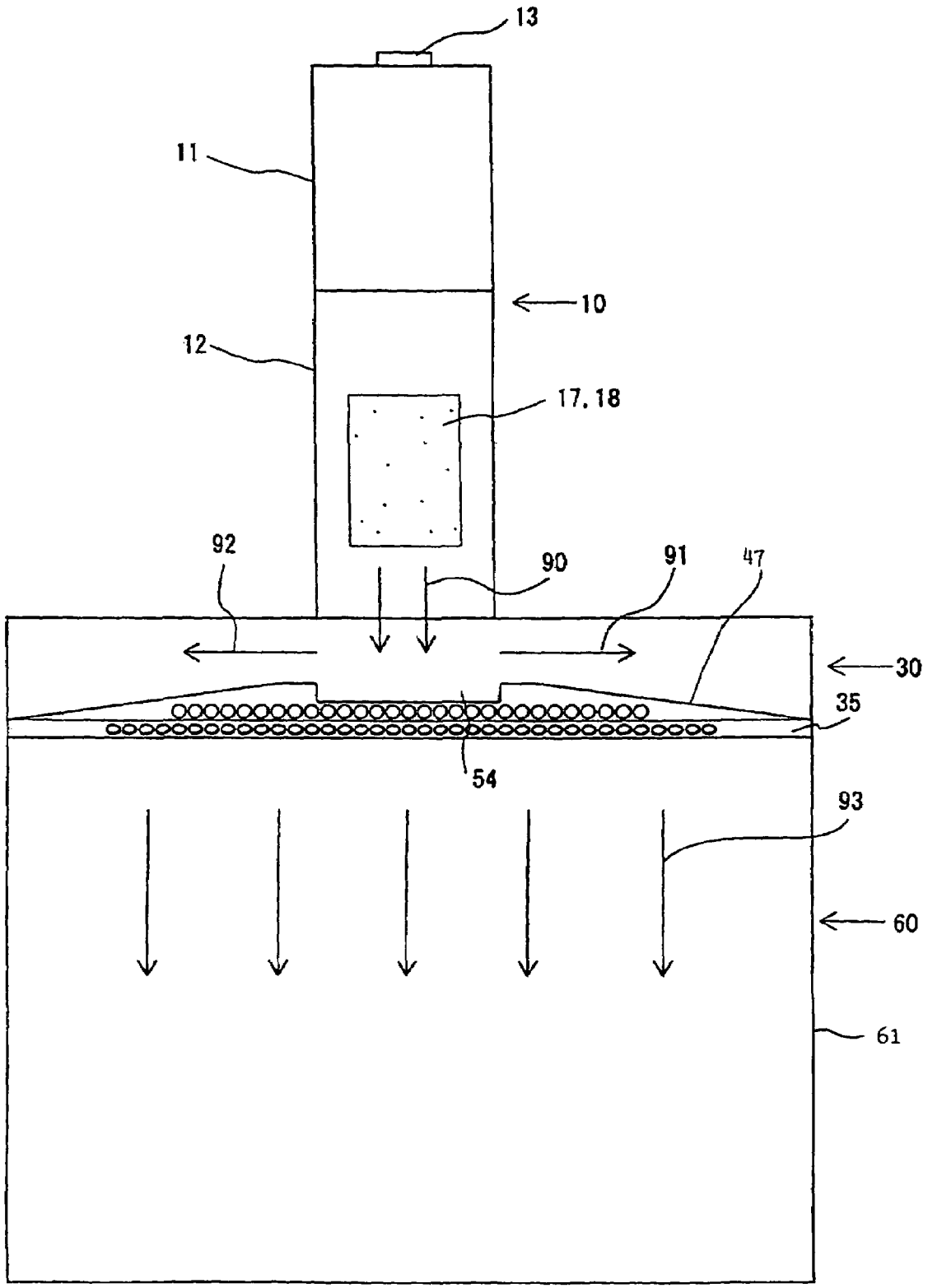
FIG. 4 is a schematic diagram for describing the actions of the distribution device of FIG. 1.

The width of the hulling section 10 (the dimension of the upper machine frame 11 and the intermediate machine frame 12 in the axial direction of the rotation shafts of the rubber rolls 17 and 18) is, as shown in FIG. 4, smaller than the width of the wind sorting section 60 and the distribution device 30. However, the hulling section 10 is so arranged that its center in the widthwise direction coincides with the center of the wind sorting section 60 and the distribution device 30 in the widthwise direction.

At the top of the upper machine frame 11 of the rice huller 1, there is formed a raw material feed port 13 for feeding the raw material (un-hulled rice to be hulled) to the pair of rubber rolls 17 and 18. On the other hand, inside this upper machine frame 11, a vibratory shifting plate 14 is fitted underneath the raw material feed port 13. This vibratory shifting plate 14 is adjustable in its frequency of vibrations so that it can convey the raw material at any desired flow rate and in a uniformed layer thickness of the flow to a guide chute 15 to be described afterwards.

Within the intermediate machine frame 12 of the rice huller 1 and underneath the vibratory shifting plate 14, the guide chute 15 whose lower end extends to the vicinity of a contact point 19 of the rubber rolls 17 and 18 is fixed with a guide chute fixing member 16. This guide chute 15 has a width substantially equal to the width of the rubber rolls 17 and 18 (the dimension in the axial direction), and its surface is formed smooth.

Within the intermediate machine frame 12 and underneath the rubber rolls 17 and 18, an upper downflow gutter 21 inclined toward the distribution device 30 is arranged between the left and right side walls of the intermediate machine frame 12. A rice receiving gutter 20 of the same width as the upper downflow gutter 21 is disposed on the upper downflow gutter 21 at the position where a line passing the lower end of the guide chute 15 and the contact point 19 between the rubber rolls 17 and 18 crosses the downflow gutter 21. Reception of the hulled rice discharged from between the rubber rolls 17 and 18 turning in reverse directions to each other by this rice receiving gutter 20 plays the part of easing impact.

The hulled rice discharged from between the rubber rolls 17 and 18 and having fallen along the upper downflow gutter 21 is accepted by the distribution device 30, where it is uniformly expanded from the width of the hulling section 10 to the width of the wind sorting section 60. This distribution device 30 will be described below.

An distribution gutter 35 constituting the distribution device 30 is fixed between the front and rear walls of the lower machine frame 61, as shown in FIG. 4. Between the upper end edge 55 of the distribution gutter 35 on the hulled rice inflow side and the upper downflow gutter 21 of the hulling section 10, as shown in FIG. 1, a lower downflow gutter 31 is disposed continuous from the inclination of the upper downflow gutter 21 to enable the hulled rice having flowed down along the upper downflow gutter 21 to flow into the distribution gutter 35 past the lower downflow gutter 31.

Figure 5:
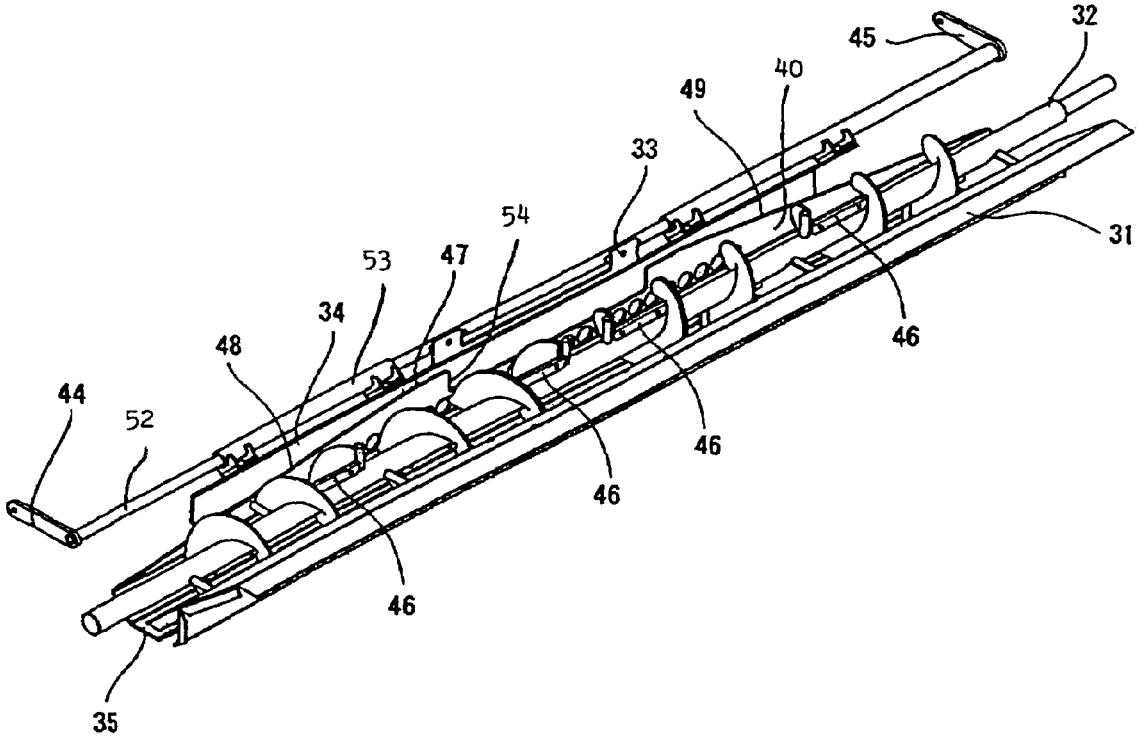
FIG. 5 is a perspective view showing the essential part of the hulled rice distribution device according to the invention.

Inside the distribution gutter 35, a screw 32 is rotatably supported. The inclinations of the vanes of the screw 32 on the left side with respect to the center of the screw 32 in the lengthwise direction are reverse to those of the screw 32 on the right side, as shown in FIG. 5. Therefore, the hulled rice, fed in the screw 32 at its central part in the lengthwise direction past the lower downflow gutter 31, is divided and conveyed toward one and the other ends of the screw 32 in the lengthwise direction by the rotation of the screw 32 through a motor and a belt (not shown).

Figure 2:
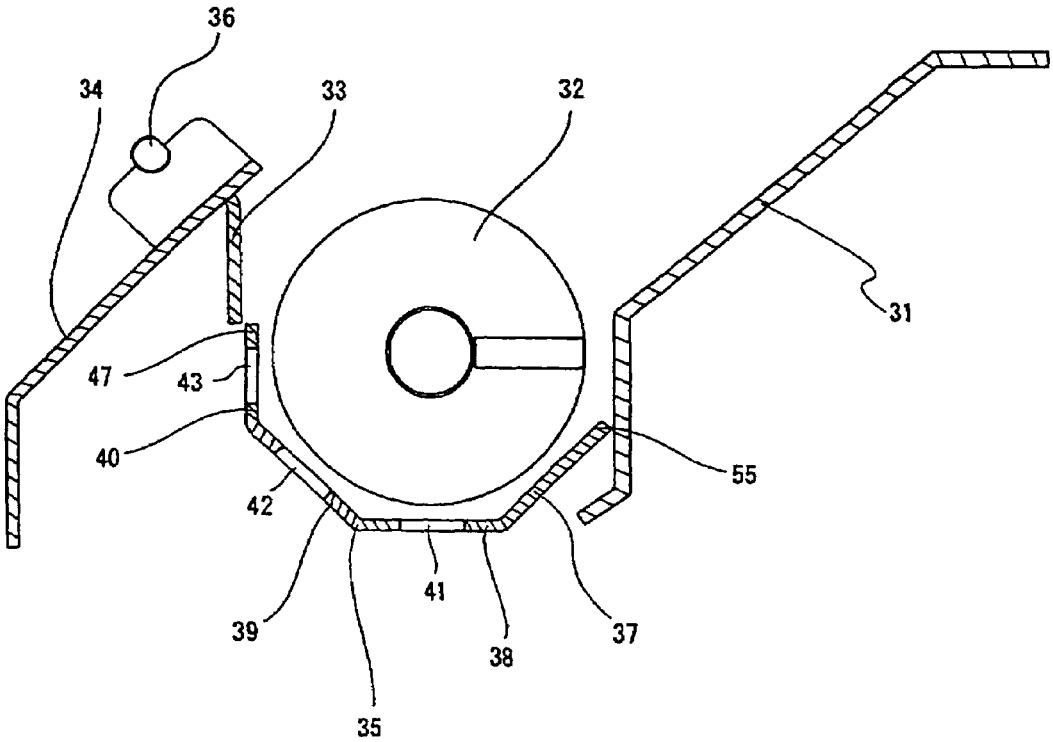
FIG. 2 is a partially enlarged view showing the distribution device of FIG. 1.

The distribution gutter 35, as shown in FIG. 2, has a structure in which four flat faces including an inflow side inclined face 37, a bottom face 38, an overflow side inclined face 39 and a vertical face 40 are joined consecutively. The bottom face 38 is on a substantially horizontal plane and, from one side edge and the side edge opposite to it, the inflow side inclined face 37 and the overflow side inclined face 39 rise at an inclination angle of about 45 degrees each. The upper of this inflow side inclined face 37 constitutes the aforementioned upper end edge 55 of the distribution gutter 35 on the hulled rice inflow side and is in line contact with the lower downflow gutter 31. On the other hand, from a side edge of the overflow side inclined face 39, opposite the side edge linked to the bottom face 38, the vertical face 40 extends upward. The upper end edge of this vertical face 40 constitutes the upper end edge 47 of the distribution gutter 35 on the hulled rice overflow side (hereinafter referred to as the overflow side upper end edge).

Figure 6:
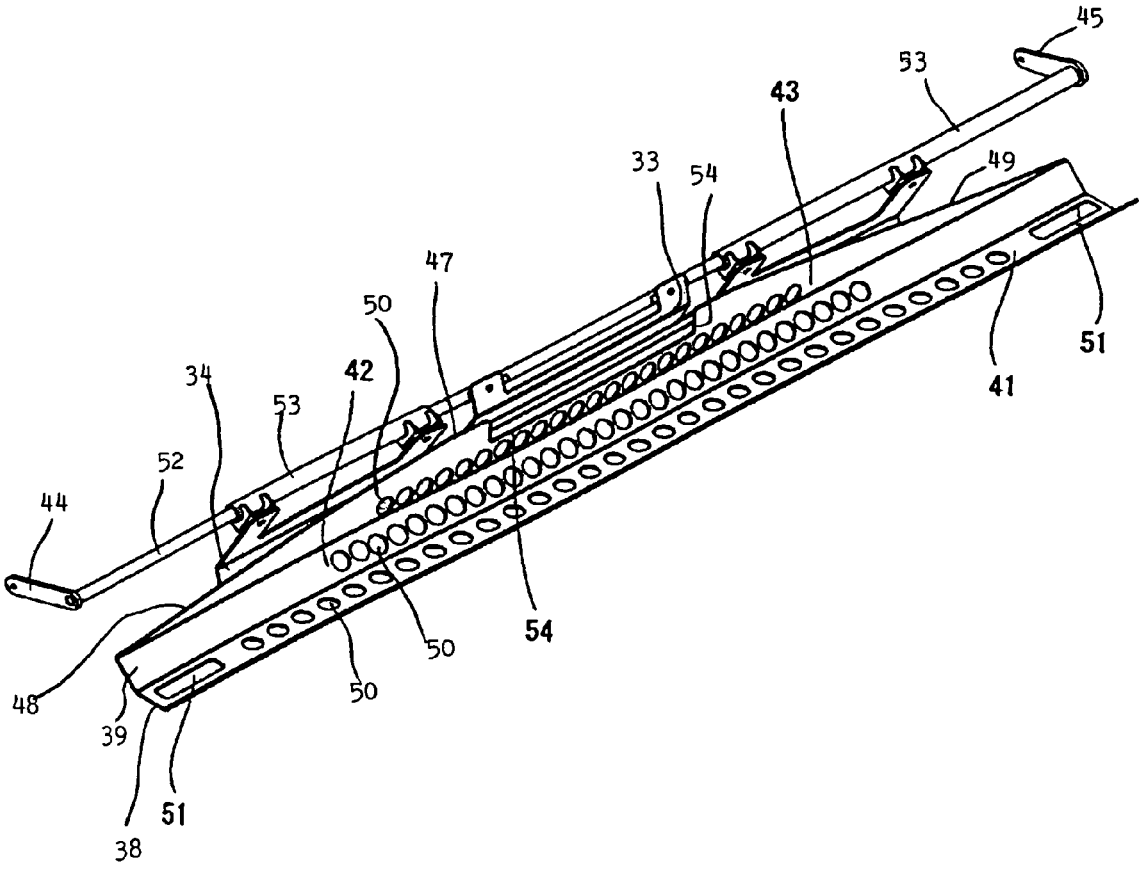
FIG. 6 is a perspective view showing the structure of the distribution device of FIG. 5, with a downflow gutter and a screw being removed from the distribution device.

In the bottom face 38 of the distribution gutter 35, as shown in FIG. 6, a plurality of round holes 50 to let the hulled rice fall down through are formed in the whole area except both ends in the lengthwise direction, and at both ends of this bottom face 38 in the lengthwise direction, rectangular holes 51 each having an area greater than those of the round holes 50 are formed. These round holes 50 and rectangular holes 51 constitute a first hole group 41.

On the other hand, in the overflow side inclined face 39 of the distribution gutter 35, a plurality of round holes 50 are formed in its central part in the lengthwise direction. These round holes 50 in the overflow side inclined face 39 constitute a second hole group 42.

Further, in the vertical face 40 of the distribution gutter 35, a plurality of round holes 50 are formed in its central part in the lengthwise direction. These round holes 50 in the vertical face 40 constitute a third hole group 43.

The diameter of each of the round holes 50 constituting these first, second and third hole groups 41, 42 and 43 is supposed to be about twice the length of the long grain un-hulled rice.

The overflow side upper end edge 47 of the vertical face 40 in the distribution gutter 35 has the shape of chevron, gradually rising from the left and right ends toward the central part. However, in the central part of the vertical face 40, as shown in FIG. 4, a rectangular recessed part 54 is formed in association with the shape of a overflowing rice control plate 33 to be described afterwards.

In the vicinity of the overflow side upper end edge 47 of the distribution gutter 35, as shown in FIG. 2, the overflowing rice control plate 33 and a falling rice control plate 34 are so supported by a double shaft structure 36 toward the lower machine frame 61 to be rotatable independent of each other. This double shaft structure 36, as shown in FIG. 3, is configured of a hollow shaft 53 and a center shaft 52 concentric with the hollow shaft 53 and inserted into that hollow shaft 53.

Figure 3:
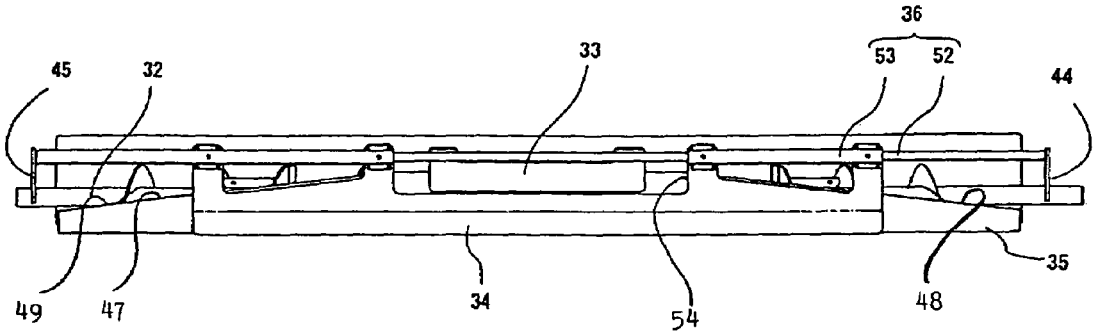
FIG. 3 is a partially enlarged view showing the essential part of the distribution device of FIG. 2.

The overflowing rice control plate 33 configured of a smooth plate is fitted to the center shaft 52 constituting a part of this double shaft structure 36 as shown in FIG. 3. One end of that center shaft 52 protrudes out of the lower machine frame 61, and an overflow rice adjusting handle 44 is fitted to the tip of that protrusion. When the overflowing rice control plate 33 is brought closer to the distribution gutter 35 by manually turning this handle 44 to rotate the center shaft 52, the overflowing rice control plate 33 controls the hulled rice in the distribution gutter 35 against overflowing the recessed part 54 outward by covering the recessed apart 54 in the distribution gutter 35 (the vertical face 40).

On the other hand, the falling rice control plate 34 configured of a smooth plate is fitted to the hollow shaft 53 constituting a part of the double shaft structure 36 as shown in FIG. 3. The falling rice control plate 34 has a sufficient width (the length of the hollow shaft 53 in the axial direction) and height to cover all of the second and third hole groups 42 and 43 respectively formed in the overflow side inclined face 39 and the vertical face 40 constituting the distribution gutter 35. Further, the falling rice control plate 34 has a V-shaped section matching the angle formed by the overflow side inclined face 39 and the vertical face 40 as shown in FIG. 2 so that it can be in tight contact with the overflow side inclined face 39 and the vertical face 40.

One end of the hollow shaft 53 protrudes out of the lower machine frame 61, and a falling rice adjusting handle 45 is fitted to the tip of that protrusion as shown in FIG. 3. The falling rice control plate 34 can be brought into tight contact with the distribution gutter 35 (the overflow side inclined face 39 and the vertical face 40) to block the second and third hole groups 42 and 43 or moved away from the distribution gutter 35 to open the second and third hole groups 42 and 43 by manually turning this handle 45 to rotate the hollow shaft 53.

Incidentally, though in the example shown in FIG. 3, the overflow rice adjusting handle 44 is fitted to the right hand side end of the double shaft structure 36 (the center shaft 52), while the falling rice adjusting handle 45 is fitted to the left hand side end of the double shaft structure 36 (the hollow shaft 53), it is also possible to arrange both of these overflow rice adjusting handle 44 and falling rice adjusting handle 45 together on either the left or right side of the double shaft structure 36.

Underneath the distribution device 30, as shown in FIG. 1, there is disposed the wind sorting section 60 for sorting the hulled rice into unpolished rice, un-hulled rice which failed to be hulled and chaff. The wind sorting section 60, having a structure of being covered with the lower machine frame 61, is provided with an air blower 68 at the bottom of the lower machine frame 61. Air blown by the air blower 68 is fed to a blast duct 69 as wide as the wind sorting section 60.

The blast duct 69 linked to the blast output of the air blower 68, after extending horizontally, is further bent upward. Linked to this bent part, first, second and third shelf plates 62, 63 and 64 are arranged, so inclined as to direct the blown air toward the upper part of the lower machine frame 61. The hulled rice falling from the distribution device 30 is blown by the wind controlled by these shelf plates 62, 63 and 64. Further, a fourth shelf plate 65 is arranged with an inclination immediately underneath the distribution device 30 to rectify the wind blowing on the hulled rice falling from the distribution device 30.

Underneath the fourth shelf plate 65, there is arranged a refined product conveying screw 70 for conveying out of the rice huller 1 unpolished rice and rice having failed to be fully hulled, which are greater in specific gravity than chaff.

The wind blown up by the first through fourth shelf plates 62 through 65 is changed in the flowing direction to downward by a fifth shelf plate 66 bent downward and a bent plate 67 opposing it. At the lower end of the bent plate 67, there is arranged a chaff conveying screw 71 for conveying out of the rice huller 1 the chaff which is smaller in specific gravity and has been blown off by the blast. Above the air blower 68, there is so disposed a suction port 72 of the air blower 68 as to suck the air having flowed around from the bent plate 67.

The operation of the rice huller described above will be described below.

The motor (not shown) is driven to rotationally drive the pair of rubber rolls 17 and 18. The rubber rolls 17 and 18, as described above, rotate in reverse directions to, and with a difference in circumferential speed from, each other. Then, the vibratory shifting plate 14 begins vibrating, receives the raw material (un-hulled rice) supplied from the raw material feed port 13, makes them a long and narrow strip of the raw material having a small thickness, and causes it to drop into the guide chute 15.

The un-hulled rice having dropped onto the guide chute 15 slides down along this guide chute 15. During that while, the un-hulled rice is so modified in posture as to make its longer axis direction parallel to the sliding direction of the un-hulled rice. And at the time the un-hulled rice falls from the lower end of the guide chute 15 to between the paired rubber rolls 17 and 18, it is fed to the rubber rolls 17 and 18 in the state of a long and narrow strip, with the individual grains so aligned that their longer axes direct substantially the same direction.

The un-hulled rice fed to between the rubber rolls 17 and 18 is squeezed between the rubber rolls 17 and 18 rotating in mutually reverse directions (each rotating inward) and at the same time, while being ground by the effect of the difference in circumferential speed between these two rubber rolls 17 and 18, passes the contact point 19 between the rubber rolls 17 and 18.

As a result, the un-hulled rice is hulled to become hulled rice consisting of unpolished rice, un-hulled rice having failed to be fully hulled and chaff. The hulled rice is thrown out of the contact point 19 between the rubber rolls 17 and 18, and received by the rice receiving gutter 20 of the upper downflow gutter 21. In the rice receiving gutter 20, hulled rice is accumulated, and the collision of hulled rice thrown out at high speed against this accumulated hulled rice buffers the impact and thereby prevents the hulled rice from being damaged.

When hulled rice is continuously thrown out toward the rice receiving gutter 20, hulled rice having overflown the rice receiving gutter 20 slides down the upper downflow gutter 21, is fed to the lower downflow gutter 31 constituting the distribution device 30, further slides down this lower downflow gutter 31, and flows into the distribution gutter 35 constituting the distribution device 30.

Arrows 90 shown in FIG. 4 represent the stream of hulled rice flowing from the hulling section 10 including the rubber rolls 17 and 18 into the distribution device 30. Since the width of the hulling section 10 (the dimension of the rubber rolls 17 and 18 in the axial direction) is smaller than the width of the distribution device 30 and the wind sorting section 60 as shown in FIG. 4, the hulled rice from the hulling section 10 locally flows into the vicinity of the center of the distribution gutter 35. Then, the distribution device 30 causes the hulled rice having flowed into the central part of the distribution gutter 35 to be conveyed toward one end and the other end in its lengthwise direction as indicated by arrows 91 and 92 in FIG. 4, and in that process of conveyances, the distribution device 30 causes the hulled rice to drop from the hole group of the distribution gutter 35 or to overflow the distribution gutter 35 beyond its upper end edge. As a result, as indicated by an arrow 93, uniform supply of hulled rice to the wind sorting section 60 all over the area in the widthwise direction is achieved.

This distribution device 30 will be described in detail with reference to FIG. 5 and FIG. 6.

The hulled rice from the hulling section 10 slides down the lower downflow gutter 31 to flow into the vicinity of the center of the distribution gutter 35. The hulled rice having flowed into the vicinity of the center of the distribution gutter 35 is conveyed by the screw 32 toward one and the other ends of the distribution gutter 35 in the lengthwise direction. The hulled rice in the distribution gutter 35, in the process of being conveyed in one direction and the other direction by the screw 32, gradually drops through the first, second and third hole groups 41 through 43 respectively formed in the bottom face 38, the overflow side inclined face 39 and the vertical face 40 of the distribution gutter 35, and fed, in the shape of a long and narrow strip of small thickness, to the wind sorting section 60.

Incidentally, in case where the flow rate of hulled rice flowing into the distribution gutter 35 is so high that letting the hulled rice fall through the first, second and third hole groups 41, 42 and 43 could not fulfill the uniform distribution, it is possible to cause the scraping plates 46, fitted to the screw 32, to scrape the hulled rice off the distribution gutter 35 and drop it beyond the overflow side upper end edge 47 of the distribution gutter 35.

Since hulled rice continuously flows into the distribution gutter 35 from the hulling section 10, much of it is piled high in the central part of the distribution gutter 35. Incidentally, since the overflow side upper end edge 47 of the distribution gutter 35 constitutes inclined portions 48 and 49 which are gradually lower toward the ends in the longitudinal direction from near the center, the quantity of hulled rice overflowing (the inclined portions 48 and 49 of) the overflow side upper end edge 47 is uniformized in the lengthwise direction of the distribution gutter 35.

The actions of the falling rice control plate 34 and the overflowing rice control plate 33 will be described in the following (A) through (D), according to the combination of the variety and flow rate of raw material (see FIG. 7A through FIG. 7D).

(A) Case in which the raw material is of a short grain variety or medium grain variety and the flow rate thereof is low (4 to 6 tons per hour):

A raw material of a short grain variety and a medium grain variety is shorter than a long grain variety in the dimension of a grain in the direction of the longer axis. When the grains of hulled rice passes the first, second and third hole groups 41, 42 and 43 of the distribution gutter 35 in a mutually overlapped state, a short grain variety and a medium grain variety are easier to drop through these hole groups 41 through 43 than a long grain variety. For this reason, hulled rice is allowed to drop only through the first hole group 41 by manipulating the falling rice adjusting handle 45 to bring the falling rice control plate 34 into contact with the vertical face 40 and the overflow side inclined face 39 of the distribution gutter 35 thereby to block the second and third hole groups 42 and 43.

Therefore, uniform distribution of hulled rice in this case is achieved, in the process of conveyance of hulled rice by the screw 32 toward both ends of the distribution gutter 35 in its lengthwise direction, by letting that hulled rice gradually fall from the first hole group 41 toward the wind sorting section 60 underneath.

Where hulled rice of a short grain variety or a medium grain variety is fed from the hulling section 10 to the distribution device 30 at a low flow rate, as described above, uniform feeding of hulled rice to the wind sorting section 60 can well be accomplished by letting this hulled rice to pass through only the first hole group 41 of the distribution gutter 35, as a result, the overflowing rice control plate 33 keeps the recessed part 54, formed in the chevron-shaped portion of the side edge 47 in the distribution gutter 35, blocked.

Figure 7A:
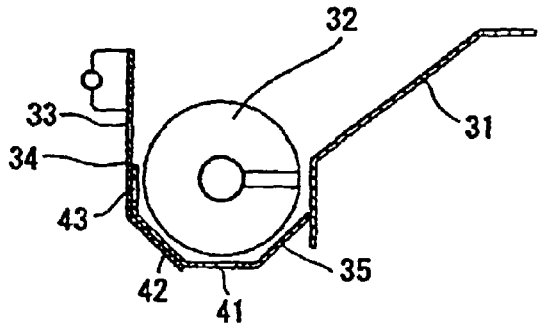
FIGS. 7A through 7D are schematic diagrams for describing the positional adjustment of a falling rice control plate and an overflowing rice control plate in the distribution device of FIG. 5.

The positions of the falling rice control plate 34 and the overflowing rice control plate 33 in this case are shown in FIG. 7A.

(B) Case in which the raw material is of a short grain variety or a medium grain variety and the flow rate thereof is high (6 to 8 tons per hour):

Since the raw material consists of a short grain variety or a medium grain variety, as in case (A) above, the second and third hole groups 42 and 43 are blocked by keeping the falling rice control plate 34 in contact with the overflow side inclined face 39 and the vertical face 40 of the distribution gutter 35.

However, as the quantity of hulled rice flowing into the distribution gutter 35 is large, no sufficient fall of hulled rice could be achieved only through the round holes 50 of the bottom face 38 constituting the first hole group 41. For this reason, a part of hulled rice which failed to fall through the round holes 50 is conveyed by the screw 32 to the vicinities of the ends of the distribution gutter 35, from where it falls through the rectangular holes 51. Further, a part of hulled rice conveyed to the ends in the lengthwise direction of the distribution gutter 35 is scraped out by means of the scraping plates 46 of the screw 32 to overflow the inclined portions 48 and 49 of the overflow side upper end edge 47.

In the state described above, the feeding of hulled rice to the wind sorting section 60 cannot be made sufficiently uniform. For this reason, by manipulating the overflow rice adjusting handle 44 to move the overflowing rice control plate 33 away from the distribution gutter 35, hulled rice is caused to overflow the central part of the distribution gutter 35 past the recessed part 54. Since the quantity of hulled rice conveyed up to the ends of the distribution gutter 35 is reduced as a result, the quantity of hulled rice overflowing the inclined portions 48 and 49 of the overflow side upper end edge 47 in the vicinities of the ends of the distribution gutter 35 decreases, thereby making possible uniform feeding of hulled rice to the wind sorting section 60.

Figure 7B:
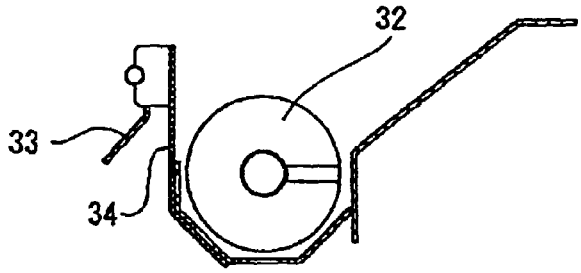

The positions of the falling rice control plate 34 and the overflowing rice control plate 33 in this case are shown in FIG. 7B.

(C) Case in which the raw material is of a long grain variety and the flow rate thereof is low (4 to 6 tons per hour):

As a raw material of a long grain variety is longer than a short grain variety in the dimension of a grain in the direction of the longer axis, it is very difficult to let one pass through the first, second and third hole groups 41, 42 and 43. For this reason, it is insufficient to let hulled rice drop through only the first hole group 41 as in case (A) described above. Accordingly, the falling rice adjusting handle 45 is manipulated to move the falling rice control plate 34 away from the overflow side inclined face 39 and the vertical face 40 of the distribution gutter 35. In this way, hulled rice is let fall through not only the first hole group 41 but also the second and third hole groups 42 and 43.

Where hulled rice of a long grain variety is to be fed from the hulling section 10 to the distribution device 30 at a low flow rate as described above, uniform feeding of hulled rice to the wind sorting section 60 can well be accomplished by letting this hulled rice pass through the first, second and third hole groups 41, 42 and 43 of the distribution gutter 35, as a result, the overflowing rice control plate 33 keeps the recessed part 54, formed in the chevron-shaped portion of the side edge 47 in the distribution gutter 35, blocked.

Figure 7C:
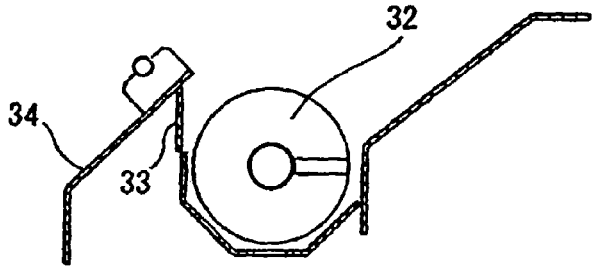

The positions of the falling rice control plate 34 and the overflowing rice control plate 33 in this case are shown in FIG. 7C.

(D) Case in which the raw material is of a long grain variety and the flow rate thereof is high (6 to 8 tons per hour):

Since the raw material consists of a long grain variety, as in case (C) above, the second and third hole groups 42 and 43 are kept open by moving the falling rice control plate 34 away from the overflow side inclined face 39 and the vertical face 40 of the distribution gutter 35.

However, as the quantity of hulled rice flowing into the distribution gutter 35 is large, sufficient fall of hulled rice could not be achieved only through the first, second and third hole groups 41, 42 and 43. For this reason, hulled rice which failed to fall through the hole groups 41, 42 and 43 is conveyed by the screw 32 to the vicinities of the ends of the distribution gutter 35, from where a part of it falls through the rectangular holes 51 constituting the first hole group 41 and another part is scraped out by means of the scraping plates 46 of the screw 32 to overflow the inclined portions 48 and 49 of the overflow side upper end edge 47.

In the state described above, the feeding of hulled rice to the wind sorting section 60 cannot be made sufficiently uniform. For this reason, by manipulating the overflow rice adjusting handle 44 to move the overflowing rice control plate 33 away from the distribution gutter 35, hulled rice is caused to overflow the central part of the distribution gutter 35 past the recessed part 54. Since the quantity of hulled rice conveyed to the ends of the distribution gutter 35 is reduced, as a result, the quantity of hulled rice overflowing the inclined portions 48 and 49 of the overflow side upper end edge 47 in the vicinities of the ends of the distribution gutter 35 decreases, thereby making possible uniform feeding of hulled rice to the wind sorting section 60.

Figure 7D:
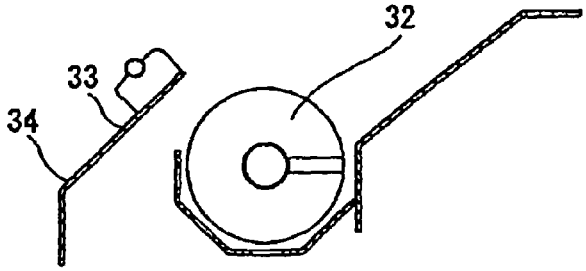

The positions of the falling rice control plate 34 and the overflowing rice control plate 33 in this case are shown in FIG. 7D.

In cases (A) through (D) described above, the falling rice control plate 34 and the overflowing rice control plate 33 can be set to the positions respectively shown in FIG. 7A through FIG. 7D by manipulating by hand the falling rice adjusting handle 45 and the overflow rice adjusting handle 44. Since these falling rice adjusting handle 45 and the overflow rice adjusting handle 44 are disposed outside the lower machine frame 61, they can be manipulated without having to stop the operation of the rice huller.

Further, by setting in advance the falling rice control plate 34 to match the variety of the raw material, the manipulation is simplified because the flow rate can be adjusted merely by setting the overflowing rice control plate 33 while checking the state of sorting.

Hulled rice, being uniformly dispersed by the distribution device 30 in its lengthwise direction, drops toward and is fed in the wind sorting section 60. Within the wind sorting section 60, the uniform stream of wind generated by the air blower 68 over the full width of the wind sorting section 60 is directed toward the blast duct 69. In the blast duct 69, the wind stream is altered in direction by about 90 degrees to turn upward. The upward directed wind is branched into sorting winds 82 and 83 by the shelf plates 63 and 64 and sorting winds 80 and 81 by the shelf plates 62 and 63.

The hulled rice fed from the distribution device 30 first runs against the sorting winds 80 and 81 to undergo sorting by the winds. Thus chaff, smaller in specific gravity, rides on the blast to be conveyed together with the sorting winds 80 and 81. Unpolished rice and un-hulled rice, greater in specific gravity than chaff, together with the part of chaff which failed to be conveyed by the draft, fall down though being exposed to the blast. The hulled rice continuing to fall passes between the shelf plate 63 and the shelf plate 64, and then runs against the sorting winds 82 and 83. Here, sorting by these sorting winds 82 and 83 is performed, in addition to sorting by the sorting winds 80 and 81. But, as the proportion of chaff in the hulled rice has already decreased in this stage, accurate sorting by wind is performed. Unpolished rice and un-hulled rice in the hulled rice having undergone sorting by wind falls onto the refined product conveying screw 70, and conveyed out of the rice huller 1.

A sorting wind 84 containing chaff, which has completed sorting by wind, joins a sorting wind 85 which also has completed sorting by wind and becomes a single stream, which is directed upward along the shelf plate 66. Then, a sorting wind 86 is changed in direction into a downward stream 87 along the bent plate 67. Then, the chaff in the sorting wind 86, greater in specific gravity than air, is subjected to a centrifugal force to hit against the bent plate 67, falls along the face of the bent plate 67 and, after flowing into the chaff conveying screw 71, conveyed out of the rice huller 1. The stream 87 separated from the chaff turns into a sorting wind 88 to be sucked by the suction port 72 of the air blower 68, and the sucked draft is accelerated by the air blower 68 for reuse in sorting by wind.

The invention claimed is:

1. A distribution device in a rice huller, wherein said rice huller includes a hulling section which hulls unhulled rice as raw material, wind sorting section arranged underneath said hulling section, and a hulled rice distribution device disposed between said hulling section and wind sorting section, said distribution device comprising:

a distribution gutter configured to receive hulled rice falling from said hulling section and in which a plurality of hulled rice falling-through holes are formed;

a downflow gutter that is linked to a first upper end edge of said distribution gutter and guides hulled rice from said hulling section to a substantially central part of the distribution gutter in the lengthwise direction;

a screw that is disposed inside said distribution gutter and conveys hulled rice having flowed into the distribution gutter in the lengthwise direction of the distribution gutter; and a falling rice control plate configured to block and open at least some of said hulled rice falling-through holes formed in said distribution gutter, wherein a part of the hulled rice that failed to fall through said hulled rice falling-through holes, out of the hulled rice that has flowed into said distribution gutter, in the process of being conveyed by said screw, is caused to overflow a second upper end edge of the distribution gutter on the side opposite the first upper end edge linked to said downflow gutter, and the second upper edge of the distribution gutter includes a recessed part that is formed in a part of the second upper edge that is substantially immediately underneath said hulling section, and an overflowing rice control plate is disposed in a position corresponding to the recessed part so as to be shiftable between a state in which said recessed part is blocked and a state in which said recessed part is opened, thereby controlling the quantity of hulled rice overflowing the distribution gutter through said recessed part.

2. The hulled rice distribution device in the rice huller according to claim 1, wherein the second upper end edge of said distribution gutter which hulled rice is to overflow is so inclined as to increase in height in the part substantially immediately underneath said hulling section and to become gradually lower with an increase in distance from that the heightened part in the lengthwise direction of the distribution gutter.

3. The hulled rice distribution device in the rice huller according to claim 1, wherein said falling rice control plate and said overflowing rice control plate are fitted to a first shaft and a second shaft concentric therewith, the first and second shafts being rotatably supported independent of each other by a machine frame of the rice huller, the rotation of the first and second shafts being capable of manipulation from outside the machine frame.

* * * * *